United States Patent [19]

Aoki

[11] Patent Number: 4,509,738

[45] Date of Patent: Apr. 9, 1985

[54] UNIVERSAL PAPER FEED CASSETTE

[75] Inventor: Naoki Aoki, Hachioji, Japan

[73] Assignee: Konishiroku Photo Industry Co., Ltd., Tokyo, Japan

[21] Appl. No.: 525,936

[22] Filed: Aug. 24, 1983

[30] Foreign Application Priority Data

Aug. 31, 1982 [JP] Japan ..... 57-151318

[51] Int. Cl.[3] ..... B65H 3/04; B65H 3/46

[52] U.S. Cl. ..... 271/160; 271/127; 271/171; 221/226; 221/242

[58] Field of Search ..... 271/160, 162, 22, 127, 271/164, 170, 171; 221/226, 231, 242; 414/118

[56] References Cited

U.S. PATENT DOCUMENTS 4,307,878 12/1981 Kono ..... 271/160

*Primary Examiner*—Bruce H. Stoner, Jr.
*Assistant Examiner*—James E. Barlow
*Attorney, Agent, or Firm*—James E. Nilles

[57] ABSTRACT

A universal paper feed cassette wherein the lift of a bottom plate adapted to be raised by a spring lift member provided on a paper feed base is regulated by a paper-pressure regulator slidable in the widthwise direction of the recording paper along the inner surface of the bottom plate and having a thickness varying in the widthwise direction thereof, so that an equal paper pressure can be obtained irrespective of the size of the recording paper. The thickness of the paper-pressure regulator varies in a stepped manner in the widthwise direction thereof.

2 Claims, 4 Drawing Figures

UNIVERSAL PAPER FEED CASSETTE

BACKGROUND OF THE INVENTION

1. Field of the Invention

This invention relates to an improvement in a paper feeder of, for example, an electrophotographic reproducing machine, and more particularly to a universal paper feed cassette capable of housing recording paper of different sizes as required.

2. Description of the Prior Art

As is well known, an electrophotographic reproducing machine is provided with a paper feeder, the construction of which is as shown in FIG. 1. In such a paper feeder, a spring lift member F which forces up a bottom plate D, on which recording paper C is placed, of a paper feed cassette A toward a paper feed unit E is provided on a paper feed base B, onto which the paper feed cassette A can be attached.

It is necessary in a paper feeder with the above construction that the contact pressure X between the recording paper C and a belt e in the paper feed unit E is maintained at a substantially constant level. The spring lift member F usually receives the spring force of a spring (not shown). Accordingly, only when a special cassette housing recording paper of a predetermined size is used, the contact pressure X, the value of which is proportional to the weight of the recording paper, can be applied thereto. However, when a universal paper feed cassette housing recording paper of various sizes is used, a contact pressure proportional to the weight of the recording paper cannot be obtained since the weight of one size of recording paper stacked to a certain thickness may be several times that of another size of recording paper stacked to the same thickness.

SUMMARY OF THE INVENTION

An object of the present invention is to provide a universal paper feed cassette which is so constructed that the recording paper is raised toward a paper feed unit by the same type of spring lift member as described above, but which is capable of obtaining a substantially equal paper pressure irrespective of the size of the recording paper housed therein.

Another object of the present invention is to provide a universal paper feed cassette which includes a paper-pressure regulator, which is linked to plates restricting the widthwise movement of the recording paper housed in the cassette, and which is attached slidably to the inner surface of a bottom plate and has a thickness which varies in the direction in which the paper-pressure regulator slides, whereby the bottom plate can be raised by a spring lift member via the paper-pressure regulator.

The above and other objects as welll as the advantageous features of the invention will become apparent from the following description of preferred embodiments taken in conjunction with the accompanying drawings.

DESCRIPTION OF THE PREFERRED EMBODIMENTS

Embodiments of the present invention will now be described in detail with reference to FIGS. 2–4.

Figure 1:
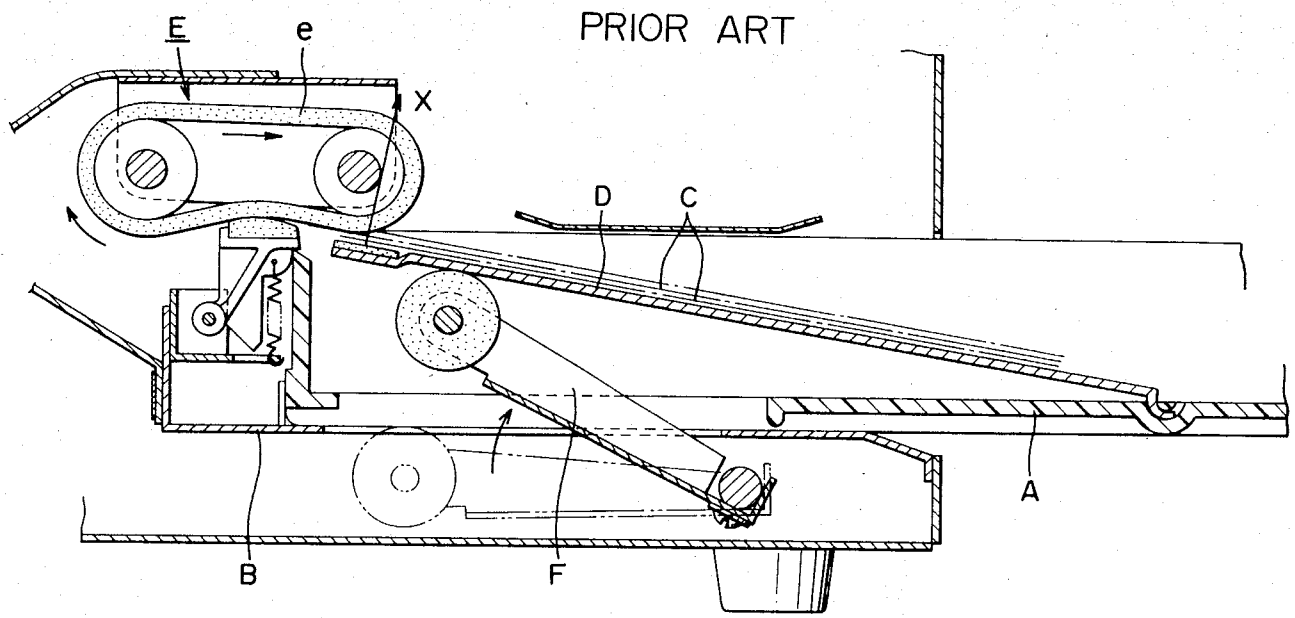
FIG. 1 PRIOR ART
FIG. 1 is a cross-section of a conventional paper feeder.
Figure 2:
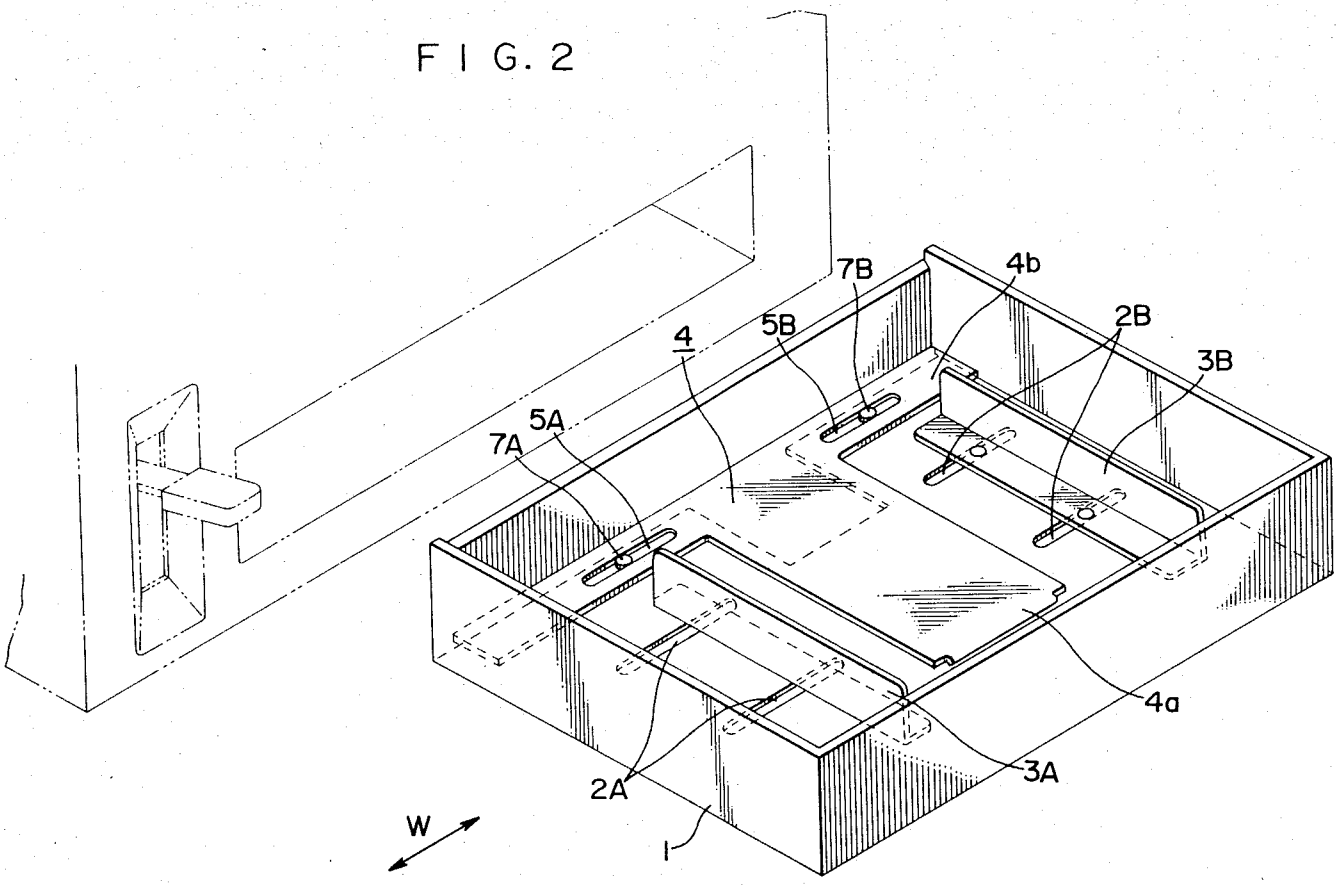
FIG. 2 is a perspective view of the complete universal paper feed cassette according to the present invention.
Figure 3:
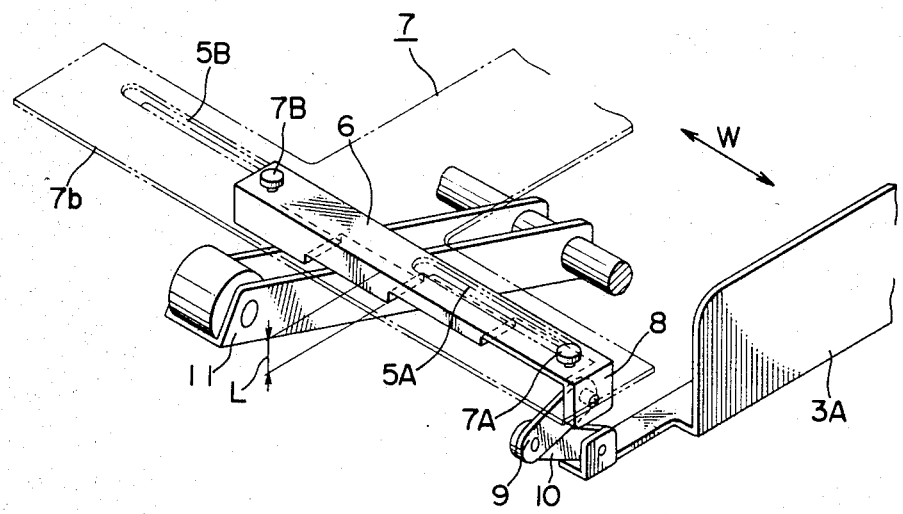
FIG. 3 is a perspective view of the principal parts of the paper feed cassette of FIG. 2.

FIGS. 2 and 3 show a first embodiment of the present invention. A open-topped, flat, box-shaped cassette body 1 is provided therein with a pair of plates 3A, 3B restricting the widthwise movement of recording paper, and the plates 3A, 3B can slide in the widthwise direction along guide grooves 2A, 2B formed in the base of the cassette body 1 so as to extend in the widthwise direction thereof. The restriction plates 3A, 3B can slide in synchronism with each other to predetermined positions by known parallel link means, the illustration of which is omitted. The cassette body 1 is further provided therein with a T-shaped bottom plate 4, on the upper surface of which recording paper can be placed. A base portion 4*a* of the T-shaped bottom plate 4 is pivotably attached to the cassette body 1.

A pair of slits 5A, 5B extending in the widthwise direction W of the cassette body 1 are formed in an upper side portion 4*b* of the bottom plate 4. A pair of guide pins 7A, 7B, mounted on the upper surface of a paper-pressure regulator 6, are positioned slidably in these slits 5A, 5B. The thickness L of the paper-pressure regulator 6 in the embodiment shown in the drawing varies in a stepped manner in the widthwise direction thereof; the thickness L could also vary in a continuous manner. A connector lug 8 at one end of the paper-pressure regulator 6 is connected to the restriction plate 3A by a pair of foldable links 9, 10. Accordingly, if the position of the restriction plate 3A is adjusted by hand according to the size of the recording paper, the paper-pressure regulator 6 is slid by the links 9, 10 in the widthwise direction W. As a result, the portion of the paper-pressure regulator 6 which has a thickness corresponding to the size of the recording paper is positioned opposite a spring lift member 11. When the bottom plate 4 is raised by the spring lift member 11, the links 9, 10 open automatically so that the movement of the bottom plate 4 is not restricted by the restriction plate 3A.

This embodiment is constructed as described above. Accordingly, when the restriction plates 3A, 3B are moved to positions corresponding to the size of the recording paper, the paper-pressure regulator 6 slides with respect to the bottom plate 4, and the bottom plate 4 is raised by the spring lift member 11 via the portion of the paper-pressure regulator 6 which has a thickness corresponding to the size of the recording paper. In other words, a substantially equal paper pressure can be obtained irrespective of the size of the recording paper since the spring force of the spring lift member 11 varies according to the thickness of the portion of the paper-pressure regulator 6 acting between the bottom plate 4 and the spring lift member 11.

Figure 4:
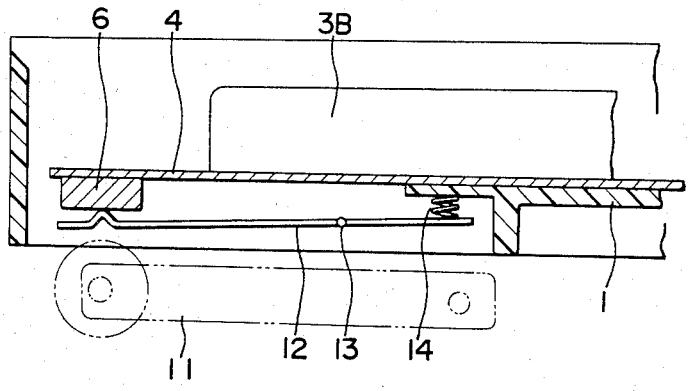
FIG. 4 is a cross-section of a second embodiment of the universal paper feed cassette according to the present invention.

FIG. 4 is a cross-section of the principal parts of a second embodiment of the present invention. This embodiment is characterized in that it has a pressure correction member 12 between the spring lift member 11 and the paper-pressure regulator 6. A fulcrum shaft 13 at an intermediate portion of the pressure correction member 12 is supported pivotably on the cassette body 1, and the pressure correction member 12 is urged in one direction by a compression spring 14 provided between it and the cassette body 1. Therefore, the rotary moment of both the spring lift member 11 and the pressure correction member 12 works on the bottom plate 4 of the universal paper feed cassette. Accordingly, the spring force of the spring lift member 11 can be corrected by regulating the rotary moment of the pressure correction member 12.

As is clear from the above description, the present invention can provide a universal paper feed cassette in which a constant paper-pressure can be obtained irrespective of the size of the recording paper housed in the cassette body, simply by attaching a pressure regulator, which is linked to plates restricting the widthwise movement of the recording paper, to a bottom plate in such a manner that the regulator can slide with respect to the bottom plate.

What is claimed is:

1. A universal paper feed cassette comprising:

a bottom plate adapted to be raised by a spring lift member provided on a paper feed base of a recording apparatus to which said universal paper feed cassette is set;

a restriction plate slidable in the widthwise direction of the recording paper and adapted to restrict the widthwise movement of the recording paper;

paper-pressure regulator slidable in the widthwise direction of the recording paper along the inner surface of said bottom plate and having a thickness varying in the widthwise direction thereof, said regulator being linked to said restriction plate, and said bottom plate being thereby raised by said spring lift member via said regulator.

2. A universal paper feed cassette of claim 1, wherein the thickness of said paper-pressure regulator varies in a stepped manner in the widthwise direction thereof.

* * * * *